US008782962B1

(12) United States Patent
Schoewe

(10) Patent No.: US 8,782,962 B1
(45) Date of Patent: Jul. 22, 2014

(54) SYSTEM AND METHOD FOR SUSPENDING STORAGE CONTAINERS

(71) Applicant: Marshall Dean Schoewe, Chandler, AZ (US)

(72) Inventor: Marshall Dean Schoewe, Chandler, AZ (US)

( * ) Notice: Subject to any disclaimer, the term of this patent is extended or adjusted under 35 U.S.C. 154(b) by 0 days.

(21) Appl. No.: 13/853,727

(22) Filed: Mar. 29, 2013

Related U.S. Application Data

(60) Provisional application No. 61/617,963, filed on Mar. 30, 2012.

(51) Int. Cl.
*G09F 7/18* (2006.01)
*E04F 19/00* (2006.01)
*E04H 14/00* (2006.01)

(52) U.S. Cl.
USPC ..... 52/39; 52/27; 52/36.4

(58) Field of Classification Search
CPC ..... E04H 6/00; E04H 6/42; E04H 6/02; E04H 6/06; A47F 5/0892; E04B 9/18
USPC ..... 52/39, 27, 36.4; 211/86.01, 113, 117, 211/71.01, 85.29, 88.01
See application file for complete search history.

(56) References Cited

U.S. PATENT DOCUMENTS

| | | | | |
|---|---|---|---|---|
| 2,349,389 | A * | 5/1944 | Thompson | 254/285 |
| 5,199,843 | A * | 4/1993 | Sferra | 414/592 |
| 5,772,295 | A * | 6/1998 | Sundmark | 312/246 |
| 6,725,608 | B1 | 4/2004 | Kraus | |
| 7,000,783 | B2 * | 2/2006 | Webb | 211/20 |
| 7,597,203 | B2 | 10/2009 | Jasniy | |
| 8,117,970 | B1 * | 2/2012 | Baez | 108/42 |
| 8,162,159 | B2 * | 4/2012 | Carter | 211/117 |
| 2007/0158286 | A1 * | 7/2007 | Beurer et al. | 211/113 |
| 2008/0036341 | A1 * | 2/2008 | Nilsen et al. | 312/246 |
| 2009/0255889 | A1 * | 10/2009 | Geffe | 211/113 |
| 2011/0083377 | A1 * | 4/2011 | Graffis | 52/27 |
| 2013/0199016 | A1 * | 8/2013 | Found | 29/428 |

* cited by examiner

*Primary Examiner* — Mark Wendell

(57) ABSTRACT

A system and method of suspending storage containers is described. The system and method comprise, among other things, coupling sets of garage door track to ceiling joists in such a manner that one or more storage containers may be suspended from the garage door tracks. The garage door tracks are configured to allow for easy placement and removal of one or more storage containers. Additionally, the garage door tracks are positioned or coupled in such a way that when the system is loaded with storage containers, the garage door tracks remain stable.

10 Claims, 5 Drawing Sheets

SYSTEM AND METHOD FOR SUSPENDING STORAGE CONTAINERS

CROSS-REFERENCE TO RELATED APPLICATION

This application is a continuation-in-part of and claims priority to U.S. Provisional Application Ser. No. 61/617,963, titled "System and Method for suspending storage containers" and filed on Mar. 30, 2012 by Marshall Schoewe.

BACKGROUND OF THE INVENTION

1. Field of the Invention

The present invention generally concerns storage systems, and more particularly, representative and exemplary embodiments of the present invention generally relate to systems, devices and methods relating to overhead suspension of storage containers and hanger apparatus.

2. Description of Related Art

Plastic storage containers have become a common household item. Frequently, people use large plastic storage containers to store a variety of items that are used infrequently such as holiday decorations and seasonal sports equipment. While plastic storage containers create a sturdy, reusable, long-lasting improvement to cardboard boxes, some problems still remain. For instance, users of plastic storage containers commonly have difficulty finding an appropriate spot to store the plastic storage containers where they will be "out of the way" and at the same time "easily accessible". One place where such a spot may be found is overhead area beneath a garage ceiling, and more particularly, the overhead area which exists between a garage ceiling and a raised garage door. Others have attempted to take advantage of such spots. Some examples are found in the following patents, the disclosures of which are hereby incorporated by reference in their entirety.

U.S. Pat. No. 7,597,203 describes a wire-frame device, mountable to a ceiling, from which plastic bins may be suspended. Unfortunately, this device is constructed from a complex array of bent wires and rails, each one requiring numerous spot welds. The device suffers from a design which is both difficult and expensive to manufacture. Furthermore, the cross-sectional upside-down 'U' shape of the device creates a major structural disadvantage. The rails of the device are essentially free to bend inward, in response to any horizontal force, without any support or structure to counteract that force or bending movement. Furthermore, the weak structural design of the device necessitates the use of specialized storage containers having large, solid lips, making the device unusable with many existing storage containers U.S. Pat. No. 6,725,608 describes suspended overhead shelves designed to fit between a raised garage door and the garage ceiling. Unfortunately, in order for this system to be sturdy, thick boards and support bars must be used. The thickness of these boards and bars wastes substantial space in an already space-limited area. Commonly, the distance between a raised garage door and the garage ceiling may measure only 10 inches. Thus a 1 inch thick bar and 1 inch thick board will take away two full inches from that space, which would mean that at maximum, only storage containers with a height of eight inches could be stored in the shelf space. This limitation makes the device unusable with many existing storage containers. Furthermore, the shelves create a space which is very difficult to access, particularly for items stored in the middle of the shelving. In addition, the cost of using suspended shelves can be substantial.

In view of the above, there remains a need for an inexpensive, simple to manufacture, easy to install, inexpensive, sturdy, safe, efficient, space saving device for taking advantage of the overhead space below a ceiling.

BRIEF SUMMARY OF THE INVENTION

The present invention provides among other things a storage container suspension system comprising a plurality of ceiling joists, a first garage door track coupled to the plurality of ceiling joists, the first garage door track having a first upper horizontal flange, a first vertical side flange integral with the first upper horizontal flange, and a first lower trough integral with the first vertical side flange. A second garage door track may be coupled to the plurality of ceiling joists, the second garage door track having a second upper horizontal flange, a second vertical side flange integral with the second upper horizontal flange, and a second lower trough integral with the second vertical side flange, wherein the first garage door track may be positioned substantially parallel to the second garage door track, and wherein the first garage door track may be positioned such that the first upper horizontal flange extends toward the second garage door track, and wherein the second garage door track may be positioned such that the second upper horizontal flange extends toward the first garage door track. The system may further comprise a storage container having an upper perimeter defining an opening to the storage container, and a circumferential lip extending outward from the upper perimeter of the storage container, and wherein the storage container may be suspended above the ground by the first garage door track and the second garage door track.

Particular implementations of the invention may further comprise one or more of the following features. The storage container suspension system may further comprise a ceiling coupled to the plurality ceiling joists, and positioned between the first and second garage tracks and the ceiling joists. The ceiling may comprise drywall. The first horizontal flange and the second horizontal flange may comprise a plurality of holes. The first and second garage tracks may be coupled to the plurality of ceiling joists by one of a nail, a screw, and a bolt. The first lower trough may comprise a first edge rail and the second lower trough may comprise a second edge rail. The first and second edge rails may comprise open-section rolled rails. The first and second edge rails may comprise rounded solid rails. The first and second edge rails may be less than 2 inches away from a lower surface of a ceiling. A portion of the circumferential lip of the storage container may be in contact with an edge of the first lower trough, and a portion of the circumferential lip of the storage container may be in contact with an edge of the second lower trough. The first and second garage tracks may be comprised of a metal. The thickness of the first and second horizontal upper flange and the thickness of the first and second vertical side flange and the thickness of the first and second lower trough may greater than $\frac{1}{8}^{th}$ inches. The first and second vertical side flanges may comprise one or more holes. A stopper may be coupled to at least one of the one or more holes.

The present invention provides among other things a method for installing a storage container suspension system comprising coupling a first garage door track to a plurality of ceiling joists, wherein the first garage door track comprises a first upper horizontal flange, a first vertical side flange integral with the first upper horizontal flange, and a first lower trough integral with the first vertical side flange. The method may further comprise coupling a second garage door track to the plurality of ceiling joists, wherein the second garage track comprises a second upper horizontal flange, a second vertical side flange integral with the second upper horizontal flange, and a second lower trough integral with the second vertical side flange, and wherein the second garage door track is positioned such that it is substantially parallel with the first garage door track, and where the second garage door track is positioned such that the first and second upper horizontal flange extend toward each other The method may further comprise suspending a storage container above the ground by the first garage door track and the second garage door track. The method may further comprise adjusting a spacer tool to measure the distance between opposing inner vertical surfaces of the storage container. The step of coupling the second garage door track to the plurality of ceiling joists may further comprise using the spacer tool to position the second garage track a distance from the first garage door track suitable for suspending the storage container above the ground. The spacer tool of method may further comprise a the spacer tool comprises a threaded rod, a first and second nut coupled to the threaded rod, a first and second spacer nut coupled to the threaded rod, a first and second wing-nut coupled to the threaded rod. The method step of adjusting a spacer tool to measure the distance between opposing inner vertical surfaces of the storage container may further comprise adjusting the position of the first and second nut along the threaded rod such that the distance between an outer edge of the first nut and an outer edge of the second nut is substantially the sane as distance between opposing inner vertical surfaces of the storage container.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographers if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
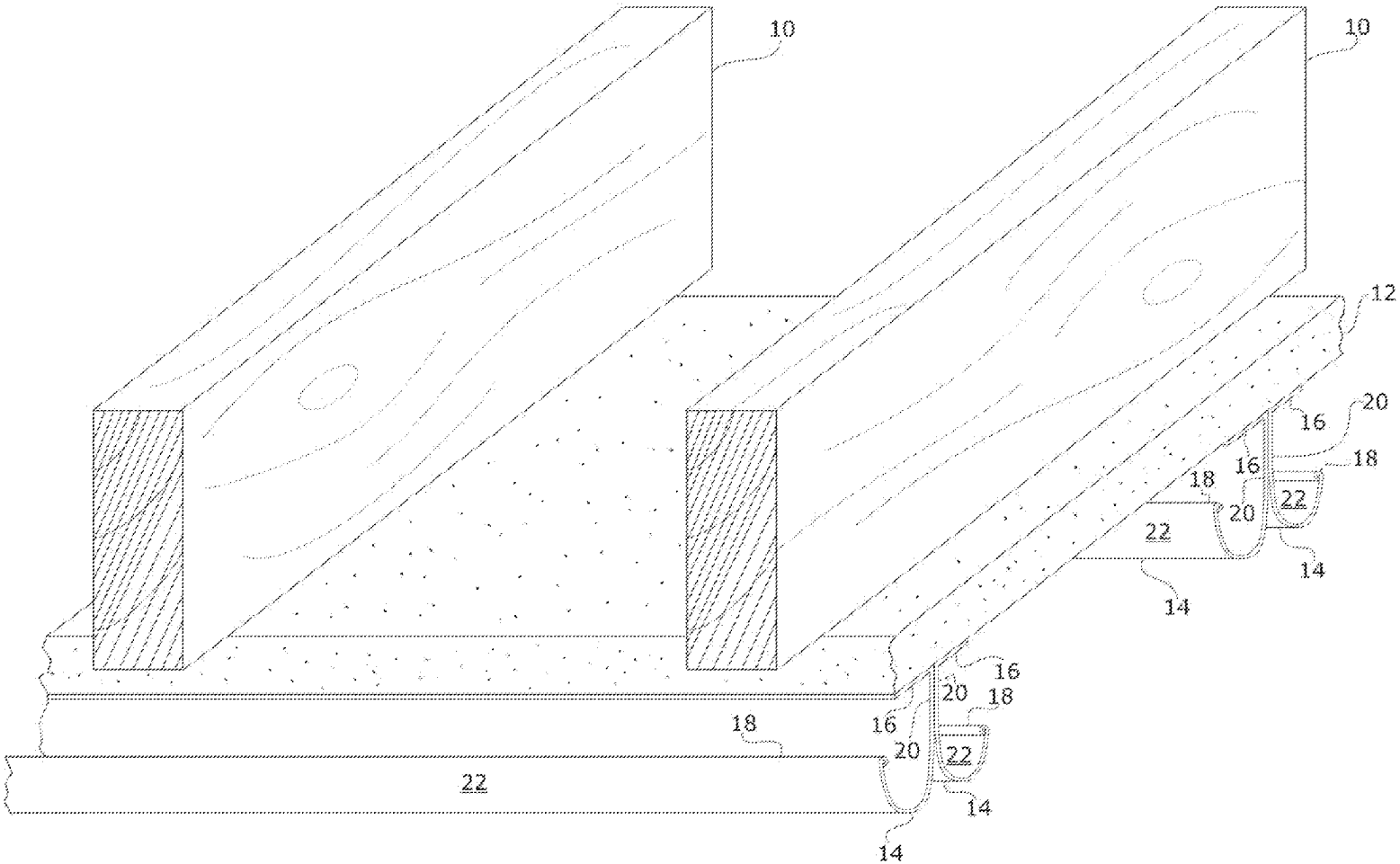
FIG. 1 depicts a perspective view of the system according to an embodiment of the invention.

FIG. 1 shows a perspective view of the storage system according to one embodiment of the invention. Ceiling joists 10 are shown as substantially parallel to each other. Generally, ceiling joists 10 are coupled to and supported by walls, frames, or other structures of a building (not shown). In the embodiment shown, ceiling joists 10 form part of a garage ceiling. Generally, in the United States, ceiling joists are spaced about 24 inches apart. The present invention is not limited to this spacing and can be easily adjusted to accommodate various configurations of ceiling joist spacing and ceiling joist orientation. In one embodiment, FIG. 1 may represent a single cell of the storage system which can be extended in any direction or repeated in any direction across a ceiling. In the embodiment shown, a ceiling 12 is attached to the bottom side of ceiling joists 10. Ceiling 12 may be comprised of a variety of materials, for example, ceiling 12 may comprise drywall, sheetrock, wood, plywood, particle board, sheet metal, or any other material commonly used to construct ceilings. In the embodiment shown, ceiling 12 is comprised of drywall. While this embodiment is probably the most common ceiling configuration found, it is not a limitation of the invention that ceiling 12 be present as a part of the storage system.

In the embodiment shown, garage door tracks 22 are coupled to ceiling joists 10 through ceiling 12. In an alternative embodiment, garage door tracks 22 may be directly attached to ceiling joists 10. Garage door tracks 22 may be coupled to ceiling joists 10 using a variety of different methods or fasteners. For example, garage door tracks may be coupled to ceiling joists 10 with nails, screws, bolts, adhesives, or other general construction fasteners. In the embodiment shown, garage door tracks 22 are coupled to ceiling joists 10 using screws (not shown). In one embodiment, construction fasteners (not shown) may pass through pre-existing holes in garage door tracks 22. In another embodiment, the construction fasteners are drilled or punched through garage door tracks 22. In the embodiment shown, garage door tracks are placed back-to-back in pairs. In an alternative embodiment, each of garage tracks 22 may be placed separate from one another. Garage tracks 22 are comprised of upper horizontal flanges 16, vertical side flanges 20, which are integral with upper horizontal flanges 16, and lower troughs 14, which are integral with vertical side flanges 20. In one embodiment, lower troughs 14 may further comprise edge rails or edge lips 18. In the embodiment shown edge rails or edge lips 18 are formed by the curled edges of lower troughs 14 forming an open-section rolled rail. Alternatively, edge rails or edge lips 18 could be formed by round, solid rails that are integral with the edges of lower troughs 14.

In the embodiment shown, garage door tracks 22 are shown to be substantially parallel to each other. Garage door tracks 22 are shown in pairs in a back-to back configuration with horizontal flanges 16, and lower troughs 14, extending outwardly in opposite directions. It is not a limitation of the current invention that garage door tracks 22 always be assembled in pairs, indeed, when installing a plurality of garage tracks 22 across a ceiling, the outermost garage door tracks of the plurality of garage door tracks may be installed solitarily.

Figure 2:
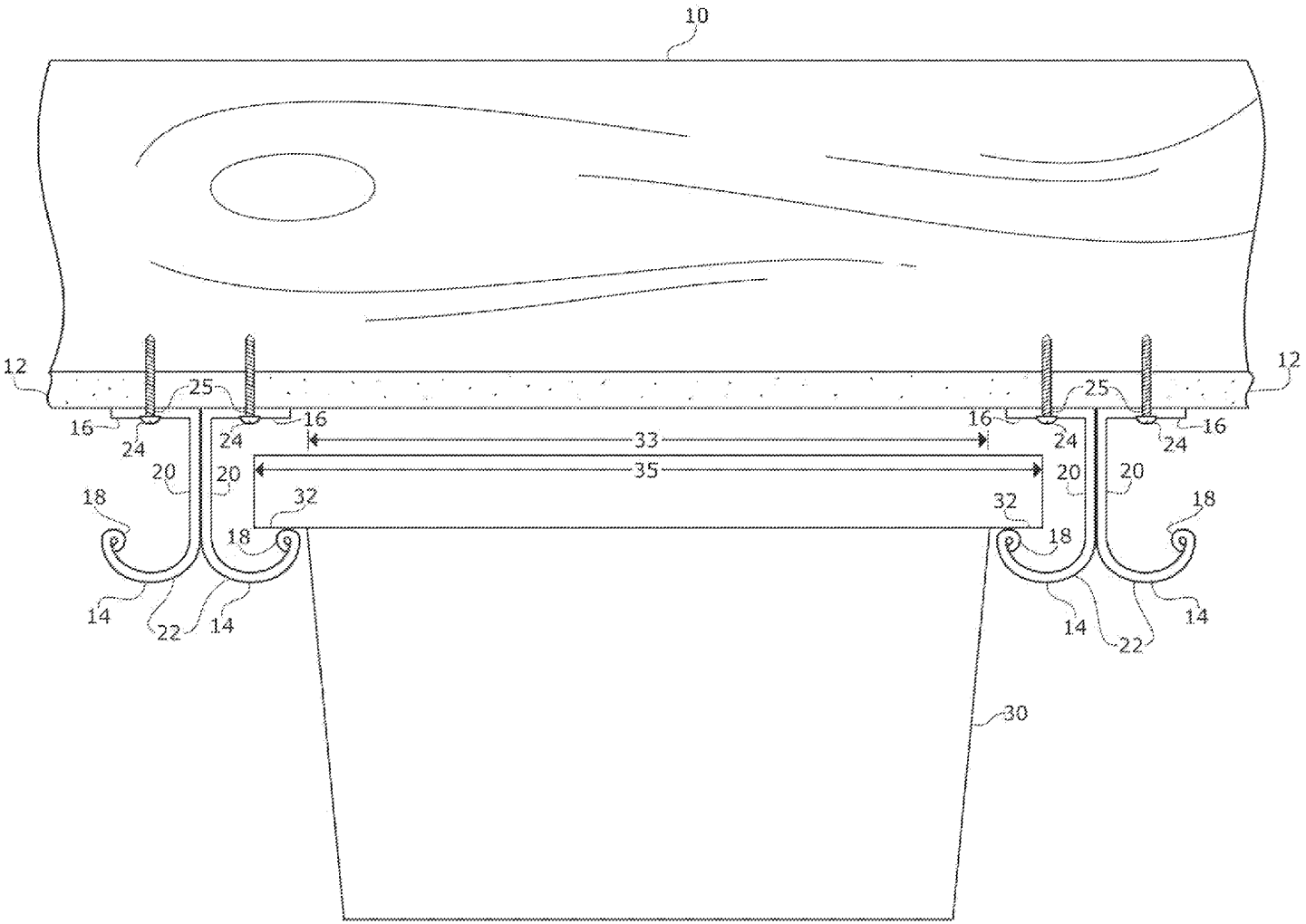
FIG. 2 depicts a cross-sectional view of the system according to an embodiment of the invention.

FIG. 2 depicts a cross-sectional view of the system according to an embodiment of the invention. This embodiment is similar to the embodiment shown in FIG. 1 and further depicts construction fasteners 24, which are used to couple garage door tracks 22 to ceiling joists 10. Construction fasteners 24 may be drilled or punched into and through upper horizontal flanges 16 of garage door tracks 22, or alternatively, construction fasteners 24 may pass through optional upper horizontal flange holes 25 in the upper horizontal flanges 16 of garage door tracks 22. In one embodiment, upper horizontal flange holes occur at 24 inch intervals along the entire length of garage door tracks 22.

FIG. 2 also depicts a storage container 30. Storage containers come in many different shapes, sizes, materials and dimensions. For example, storage container 30 could have an opening that is rectangular, circular, or some other geometric shape. Generally, storage container 30 has an inner container width 33 and an outer container width 35. The inner container width 33 may be described as the distance between opposing inner vertical surfaces of the storage container. The outer container width 35 may be described as the distance between the outer edges of container lips 32. As shown, storage container 30 can be suspended by garage door tracks 22. As shown, edge rails 18 provide a surface upon which container lips 32 can rest and glide along for loading and unloading. A unique method for appropriately positioning garage door tracks 22 such that storage container 30 can be easily placed in and out of a suspended position will be discussed later in FIG. 4.

As described earlier in FIG. 1, the embodiment shown may be cellular and can be extended in planar directions across ceiling 12, thus accommodating one or multiple rows of storage container 30, wherein each row may comprise one or multiple storage containers 30.

Figure 3:
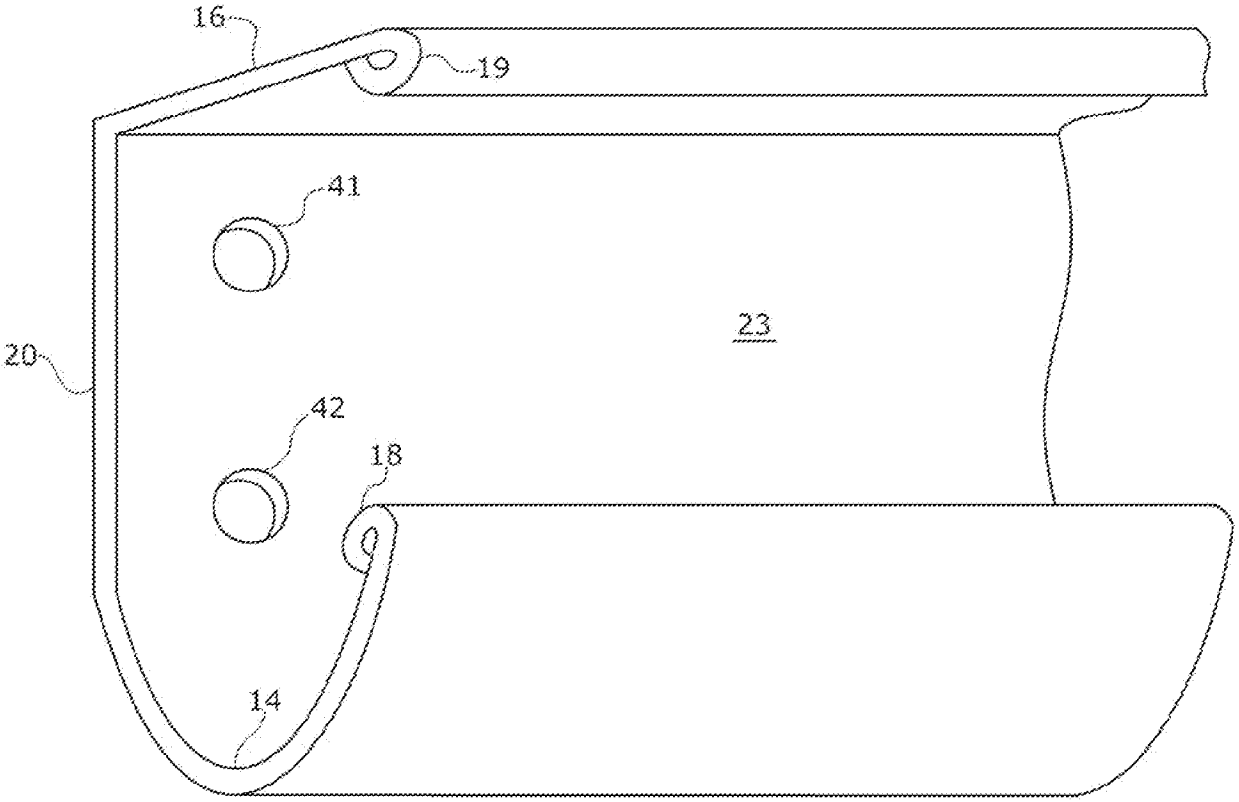
FIG. 3 depicts perspective view of a portion of the garage door track according to an embodiment of the invention.

One advantage of the embodiment shown is that when storage containers 30 are properly set into place and suspended by garage door tracks 22, vertically directed forces on one track are substantially counterbalanced by vertically directed forces in the opposite direction from an adjacent or back-to-back garage door track. This advantage is especially apparent when there is at least one storage container 30 suspended from each row of garage door track 22. This advantage creates a more ridged and stable suspension system wherein horizontal flanges 20 are not subject to bending inwardly or outwardly under normal operating circumstances. Additionally, this advantage allows for the use of storage containers with smaller container lips FIG. 3 depicts a perspective view of a portion of the garage door track 23 according to an embodiment of the invention. This embodiment of garage door track 23 is similar to the garage door track in earlier figures, but additionally comprises optional vertical side flange holes 41 and 42 and optional upper horizontal flange holes (not shown). Vertical side flange holes 41 and 42, and upper horizontal flange holes are useful for installation purposes. As discussed earlier, optional upper horizontal flange holes may provide a passage for a construction fastener, such as a nail, screw, bolt or other general construction fastener, to pass through and thereby couple the garage door track 23 to a ceiling joist.

Optional vertical side flange holes 41 and 42 are useful for coupling a spacer tool (shown in FIG. 4) to garage door track 23 for the purpose of distancing, positioning and aligning two garage door tracks during installation. Additionally, a stopper (not shown), such as a bolt, screw, rod, rubber stopper, lock, padlock, or other conventional stopper, may be coupled to one or both of side flange holes 41 and 42. The stopper may provide the function of stopping a storage container from sliding or passing over the edge of the end of the garage door track. Other embodiments of the invention may simply have a stopper which is integral with the garage door track or coupled in a different manner to the garage door track.

FIG. 3 also depicts an upper horizontal flange rail 19. Similar to edge rails or edge lips 18 upper horizontal flange rail 19 may be formed by a curled edge of the upper horizontal flange 16 forming an open-section rolled rail as depicted in FIG. 3. Alternatively, edge rail 19 could be a round, solid rail integral with the upper horizontal flange 16.

Figure 4:
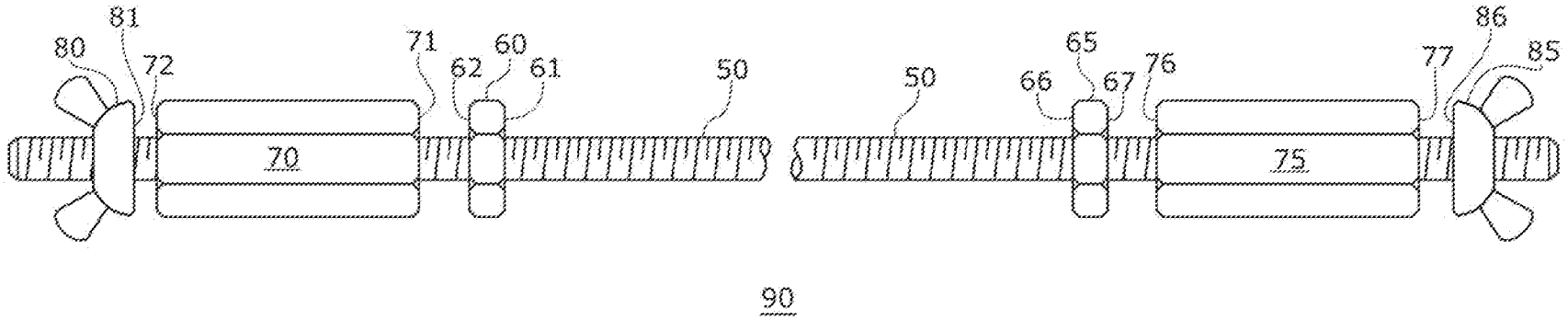
FIG. 4 depicts a front view of a spacer tool according to an embodiment of the invention.

FIG. 4 depicts a front-view of the spacer tool 90 according to an embodiment of the invention. Spacer tool 90 may be helpful for installation of garage door tracks and specifically for distancing, positioning and aligning garage door tracks.

Spacer tool 90 comprises threaded rod 50, which may be made of metal plastic or any other material suitable for adjusting inner nuts 60 and 65, spacer nuts 70 and 75, and outer nuts 80 and 85, along its length. The length and diameter of threaded rod 50 may be any reasonable size considering the threaded rod's application. In one embodiment, threaded rod 50 is a metal threaded ¼ inch rod that is 24 inches long. A length of 24 inches corresponds to a standard distance of separation of the centers of two adjacent ceiling joists, and thus enables use of the rod for convenience and ease of determining the location of ceiling joists above a ceiling.

Coupled to the threaded rod may be inner nuts 60 and 65, spacer nuts 70 and 75, and outer nuts 80 and 85. Each of inner nuts 60 and 65 has an inner surface, 61 and 66 respectively, and an outer surface, 62 and 67 respectively. Spacer nuts 70 and 75 have inner surfaces 71 and 76 respectively and outer surfaces 72 and 77 respectively. And outer nuts 80 and 85 have inner surfaces 81 and 86 respectively. The lengths of spacer nuts 70 and 75 are chosen so as to correspond substantially to the horizontal distance between a vertical side flange of a garage door track and an edge or edge rail of a lower trough of the same garage door track. In one embodiment, spacer nuts are approximately ⅞ inches long each. It may be noted that there exist many different types and sizes of nuts and consequently inner nuts 60 and 65, spacer nuts 70 and 75, and outer nuts 80 and 85, could be interchanged with other types and sizes of similar nuts. For example, outer nuts 80 and 85 may be wing nuts as shown in FIG. 4, or, outer nuts 80 and 85 could alternatively be hex nuts similar to inner nuts 60 and 65. Furthermore, as an example, the spacer nuts 70 and 75 may be chosen to have a length substantially equal to the distance between the inner wall of a vertical side flange 20 of a garage door track 22 and an edge 18 of a lower trough of the garage door track 22.

Spacer tool 90 is useful for positioning garage door tracks relative to the width of storage containers. For example, spacer tool 90 may be used in conjunction with a storage container by adjusting the position of inner nuts 60 and 65 along the threaded rod 90 so that the distance between outer surfaces 62 and 67 is substantially equal to the distance between opposing inner vertical surfaces of the storage container. It may be noted that the walls of some storage containers have a tendency to "bow" outwardly at the midsection of the storage container. In this instance, it may be preferable to adjust the outer surfaces 62 and 67 of inner nuts 60 and 65 so that the distance between outer surfaces 62 and 67 is substantially equal to the distance between opposing inner vertical surfaces of the storage container at or near the edge of the storage container. This will help to ensure a more even load dispersion along a vertical edge of a storage container when the storage container is suspended from garage door tracks.

Once inner nuts 60 and 65 are in position, the inner surfaces 71 and 76 of spacer nuts 70 and 75 may be adjusted so as to abut the outer surfaces 62 and 67 of inner nuts 60 and 65 so as to lock inner nuts 60 and 65 in their places.

At this point, spacer tool 90 can be used in conjunction with a first pre-mounted garage door track. If the first pre-mounted garage door track has vertical side flange holes, then one end of the spacer tool may be placed through the vertical side flange hole so as to bring into contact the inner surface of the vertical side flange and the outer surface 72 of spacer nut 70. Next, outer nut 80 may be used to secure spacer tool 90 to the vertical side flange of the pre-mounted garage door track. Next, a second, un-mounted garage door track can be appropriately positioned with respect to the pre-mounted garage door track by bringing the second end of the spacer tool through a vertical side flange hole of the un-mounted garage door track so as to bring into contact the inner surface of the vertical side flange of the un-mounted garage door track with the outer surface 77 of spacer nut 75. It may be noted that throughout the installation process, it may be desirable to use one or more spacer tools simultaneously according to the above described method. Next, with the second un-mounted garage door track positioned the correct distance away from the pre-mounted garage door track, outer nut 85 may be used to secure spacer tool 90 to the vertical side flange of the un-mounted garage door track. At this point, the un-mounted garage door track can be mounted to the above ceiling joists at the appropriate locations.

Using the above mentioned mounting method results in two mounted garage door tracks which are positioned so as to allow the suspension of the originally measured storage container. This method of installation allows for rapid, custom fit, tight tolerances and accurate installation of the storage container suspension system. The tight tolerances and accurate installation achieved by the use of spacer tool 90 allows for the use of storage containers which have minimally protruding container lips.

In alternative embodiments, inner nuts 60 and 65, spacer nuts 70 and 75 and outer nuts 80 and 85 may be chosen from a variety of different hardware parts that are accomplish the abovementioned purposes of spacer tool 90.

Figure 5:
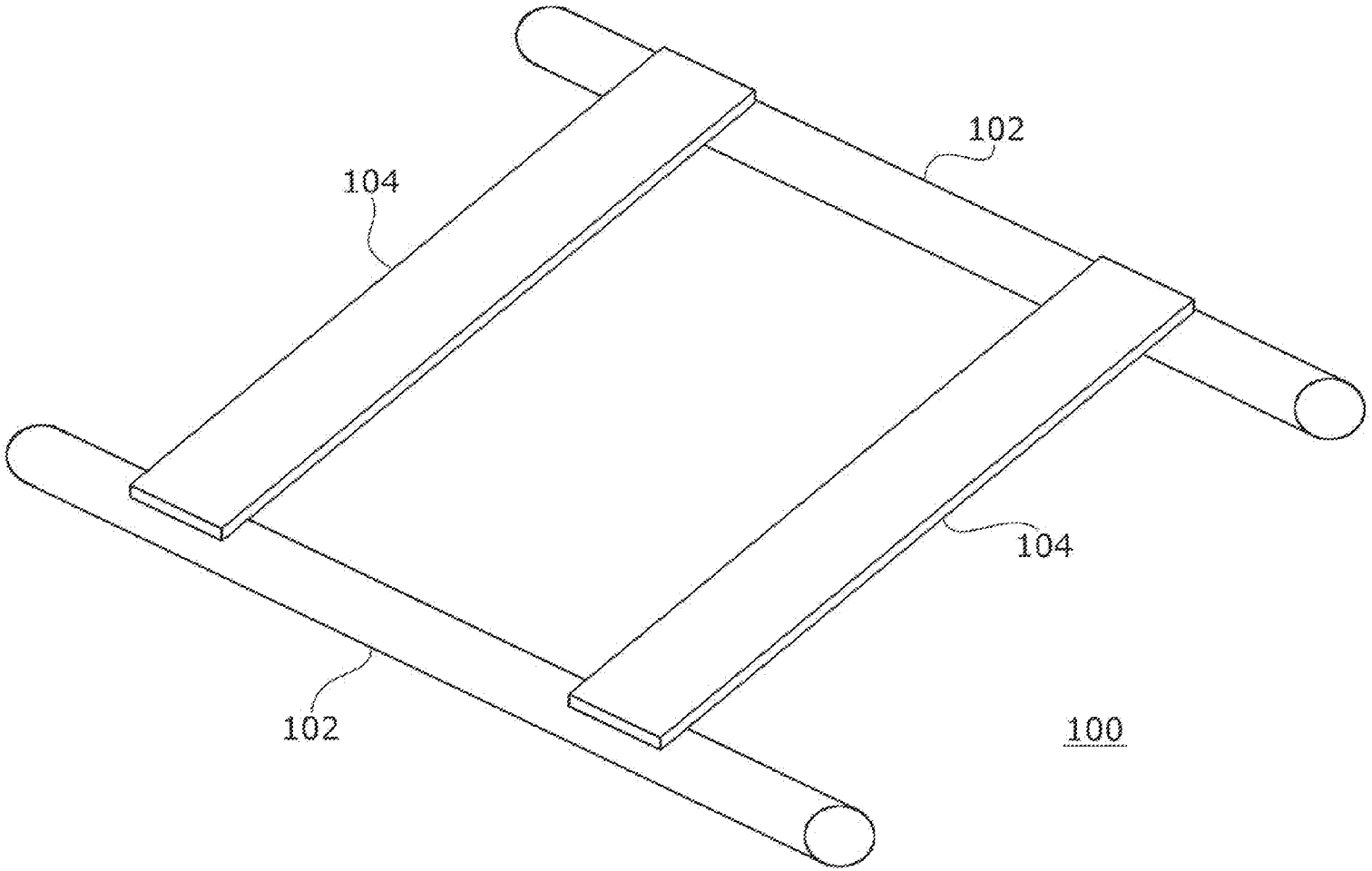
FIG. 5 depicts a perspective view of a hanger cart according to an embodiment of the invention.

FIG. 5 depicts a hanger cart 100 according to one embodiment of the invention. Hanger cart 100 may be used in conjunction with the garage door track to provide the ability to suspend an almost endless variety of different things. Hanger cart 100 is comprised of round rails 102 and cross members 104. Round rails may be solid or tubular. The diameter of round rails 102 is chosen so as to allow round rails 102 to rest within the lower troughs of garage door tracks. When hanger cart 100 is positioned with round rails 102 resting in the lower troughs of mounted garage door tracks, cross members 104 can be used to suspend an almost endless variety of objects. In an alternative embodiment, hanger cart 100 may be rotated such that round rails 102 are positioned perpendicular to the garage door tracks. In this configuration round rails 102 only come into contact with the edge or rail of the lower trough. This configuration allows for less sliding resistance of hanger cart 100, and allows hanger cart 100 to be moved easily along the garage door track. It is contemplated that an endless variety of additional options may be added to hanger cart 100 that would allow for greater configurability of the suspension system. For example, wheels could be added to the ends of round rails 102 and could be configured to set in the lower troughs of the garage door track which would allow hanger cart 100 to slide very easily up and down the garage door tracks. As another example, hooks could be attached to cross members 104 and would allow for suspension of more custom or specific objects.

I claim:

1. A storage container suspension system, comprising:

a plurality of ceiling joists;

a first garage door track coupled to the plurality of ceiling joists, the first garage door track having a first upper horizontal flange, a first vertical side flange integral with file first upper horizontal flange, and a first lower trough integral with the first vertical side flange, wherein said first lower trough includes a first curled edge rail;

a second garage door track coupled to the plurality of ceiling joists, the second garage door track having a second upper horizontal flange, a second vertical side flange integral with the second upper horizontal flange, and a second lower trough integral with the second vertical side flange, wherein said second lower trough includes a second curled edge rail, and wherein the first garage door track is positioned substantially parallel to the second garage door track, and wherein the first garage door track is positioned such that the first upper horizontal flange extends toward the second garage door track, and wherein the second garage door track is positioned such that the second upper horizontal flange extends toward the first garage door track; and a storage container having an upper perimeter defining an opening to the storage container, and a circumferential lip extending outward from the upper perimeter of the storage container, and wherein the storage container is suspended above the ground by the first garage door track and the second garage door track, wherein the circumferential lip rests upon said first curled edge rail and said second curled edge rail, and wherein said first lower trough and said second lower trough are configured to allow objects to set therein.

2. The storage container suspension system of claim 1, further comprising a ceiling coupled to the plurality ceiling joists, and positioned between the first and second garage tracks and the ceiling joists.

3. The storage container suspension system of claim 2, wherein the ceiling comprises drywall.

4. The storage container suspension system of claim 1, wherein the first horizontal flange and the second horizontal flange comprise a plurality of holes.

5. The storage container suspension system of claim 4, wherein the first and second garage tracks are coupled to the plurality of ceiling joists by one of a nail, a screw, and a bolt.

6. The storage container suspension system of claim 1 wherein the first and second edge rails are less than 2 inches away from a lower surface of a ceiling.

7. A method for installing a storage container suspension system comprising:

coupling a first garage door track to a plurality of ceiling joists, wherein the first garage door track comprises a first upper horizontal flange, a first vertical side flange integral with the first upper horizontal flange, and a first lower trough integral with the first vertical side flange and wherein said first lower trough includes a first curled edge rail;

coupling a second garage door track to the plurality of ceiling joists, wherein the second garage track comprises a second upper horizontal flange, a second vertical side flange integral with the second upper horizontal flange, and a second lower trough integral with the second vertical side flange, wherein said second lower trough includes a second curled edge rail, and wherein the second garage door track is positioned such that it is substantially parallel with the first garage door track, and where the second garage door track is positioned such that the first and second upper horizontal flange extend toward each other; and suspending a storage container above the ground by the first garage door track and the second garage door track.

8. The method of claim 7, further comprising:

adjusting a spacer tool to measure the distance between opposing inner vertical surfaces of the storage container;

and wherein the step of coupling the second garage door track to the plurality of ceiling joists further comprises using the spacer tool to position the second garage track a distance from the first garage door track suitable for suspending the storage container above the ground.

9. The method of claim 8, wherein the spacer tool comprises:

a threaded rod;

a first and second nut coupled to the threaded rod;

a first and second spacer nut coupled to the threaded rod;

and a first and second wing-nut coupled to the threaded rod.

10. The method of claim 9, wherein the step of adjusting a spacer tool to measure the distance between opposing inner vertical surfaces of the storage container comprises:

adjusting the position of the first and second nut along the threaded rod such that the distance between an outer edge of the first nut and an outer edge of the second nut is substantially the same as distance between opposing inner vertical surfaces of the storage container.

* * * * *